United States Patent [19]

McGhie

[11] Patent Number: 4,995,518

[45] Date of Patent: Feb. 26, 1991

[54] DETACHABLE FLOATING COUNTERWEIGHT

[76] Inventor: James R. McGhie, 4362 Metcalf Dr., Eagan, Minn. 55122

[21] Appl. No.: 392,470

[22] Filed: Aug. 11, 1989

[51] Int. Cl.[5] ..... B66C 23/74

[52] U.S. Cl. ..... 212/178; 212/195; 212/196

[58] Field of Search ..... 212/178, 195, 196, 197, 212/198

[56] References Cited

U.S. PATENT DOCUMENTS

| | | | |
|---|---|---|---|
| 752,248 | 2/1904 | Nickerson | 212/197 |
| 4,196,816 | 4/1980 | Dvorsky et al. | 212/195 |
| 4,508,232 | 4/1985 | Lampson | 212/198 |
| 4,614,275 | 9/1986 | Zenno | 212/198 |
| 4,729,486 | 3/1988 | Petzold et al. | 212/197 |

FOREIGN PATENT DOCUMENTS

| | | | |
|---|---|---|---|
| 3228301 | 2/1984 | Fed. Rep. of Germany | 212/195 |
| 53-353 | 4/1977 | Japan | 212/196 |
| 59-26494 | 2/1984 | Japan | 212/196 |

*Primary Examiner*—Sherman Basinger
*Assistant Examiner*—Thomas J. Brahan
*Attorney, Agent, or Firm*—Paul L. Sjoquist

[57] ABSTRACT

A portable crane having an outwardly-extending counterweight arm and detachable counterweight for detachment therefrom, for transport of said crane separate from transport of the counterweight. The counterweight has a base which may be extended and retracted from the counterweight, to provide a variable support for the counterweight.

17 Claims, 2 Drawing Sheets

DETACHABLE FLOATING COUNTERWEIGHT

Background of the Invention

The present invention relates generally to heavy lift cranes for use in the construction industry, and more particularly to a self-attaching powered counterweight therefor, detachable for transport of the crane.

Most construction companies will have one or more general, all-purpose truck cranes or crawler cranes which are usable in the majority of lifting and moving projects encountered in a typical construction project. Such cranes currently have reached the size and weight limitations for ease of transport among the various job sites on public roads while the lift capacity requirements of the construction industry have continued to increase. Often the overweight crane can be reduced in weight by merely removing the counterweight for transport. However, removal of the counterweight most often requires the use of a second crane thereby defeating much of the advantage of counterweight removal. Thus far, the occasional heavy lift requirements have necessitated the purchase or rental by the construction company of a larger, less portable crane usable in only very limited circumstances.

Designers of portable lift cranes are faced with the conundrum of creating a portable crane that is readily transportable among the various job sites within existing highway size and weight regulations while increasing the lifting capacity of the crane thus designed. The ideal construction crane would be sufficiently small and light to be readily transported over existing public highways without necessitating the acquisition of special permits for oversize or overweight loads while having the ability to lift heavier loads. At present, this ideal crane has not been designed.

Various methods of extendable or removable counterweights for use with cranes are revealed in the prior art. U.S. Pat. No. 1,877,373 issued to Cohen-Venezian on Sept. 13, 1932, discloses a portable lift crane having an extendable counterweight. While the counterweight is extendable to offset the forces applied by lifting, it is fixed with the crane and nonremovable. This may increase the lifting capacity of the crane, but does not decrease the total weight of the crane.

A group of patents provide movable counterweights which are extendable for increasing the counterweighting force and retractable to provide better balance to the crane when it is being operated in a non-loaded posture. These patents include U.S. Pat. No. 3,547,278, issued to Tayler, on Dec. 15, 1970, U.S. Pat. No. 3,653,486, issued to McLean, et al, on Apr. 4, 1972, U.S. Pat. No. 3,938,669, issued to Vinton on Feb. 17, 1976, and U.S. Pat. No. 3,945,518, issued to Inoue on Mar. 23, 1976. While the above-indicated referenced patents provide an increased counterweighting force by extending the respective counterweights outwardly from the crane unit, none disclose or contemplate the use of removable counterweights and therefore would require substantial disassembly to reduce their weight for transport.

U.S. Pat. No. 3,375,021, issued to Grider on Mar. 26, 1968, discloses a removable counterweight device for inclusion in a transit crane. While the Grider device does provide for removal of the counterweight from the crane's structure, it does not provide for either removal of the counterweight from the transport structure or extension of the counterweight out from the pivot center of the crane to increase the counterweighting effect, while decreasing the transport weight of the crane assembly.

U.S. Pat. No. 3,902,735, issued to Bertram, et al, Sept. 2, 1975, reveals a hydraulic counterweight removal mechanism. While Bertram provides a self-removable counterweight allowing the total weight of the crane to be decreased for transport, it does not provide for locating the counterweight so that the counterweight may be readily transported to another site, nor does it provide for displacing the counterweight from the center pivot crane to increase the counterbalancing effect of the counterweight.

The above-described patents are representative of several approaches taken to resolve the conflicting requirements of providing a portable lift crane which is readily transportable over public highways while increasing the lifting capacity of the portable crane. The present invention is directed to a hydraulically-powered counterweight assembly attached at an extended distance from the pivot center of the crane. Thus, the powered counterweight may be readily attached or detached from the crane for storage or transport without requiring the use of a second crane and the extension of the counterweight outwardly from the pivot center of the crane allows the use of a lighter counterweight to provide the same counterweighting effect and further allows increasing the lift capacity of the crane without increasing the total mass of the crane.

SUMMARY OF THE INVENTION

It is an object of the present invention to provide an improved portable lift crane having an increased lift capacity without a corresponding increase in total crane weight.

Another object of the invention is to provide powered counterweight for self-attachment to the crane without use of additional equipment.

Another object of the invention is to provide a height-adjustable counterweight which may be disposed a varying distance above the ground surface.

Another object of the invention is to provide increased stability underslung counterweight for increasing the lift capacity of the crane.

Another object of the invention is to provide an increased stability counterweight which can safely impose an 85 percent tipping moment upon the crane.

The principal feature of the current invention provides a powered self-attachable counterweight which may be attached to or detached from a crane for storage or transport without utilizing other additional equipment.

Another feature of the invention is the provision of a powered counterweight which may be transported to a work site on a separate vehicle ready for easy attachment to a crane.

Another feature of the invention is the provision of a counterweight circumscribing a larger swing radius.

Another feature of the invention is the provision of an underslung counterweight increasing the stability of the crane.

Another feature of the invention is the provision of an underslung counterweight disposed near the surface so as to minimize the risk of damage in the event of tipping.

Brief Description of the Drawings

FIG. 3 is a partial side elevational view, like FIG. 2, showing a second preferred embodiment of the

DETAILED DESCRIPTION OF THE EMBODIMENT

The present invention utilizes many of the standard elements found on truck cranes and crawler cranes. Although the invention as described herein is with reference to truck cranes, it should be understood that the necessary elements are also found on crawler cranes which may be equally adaptable for use in the present invention.

Figure 1:
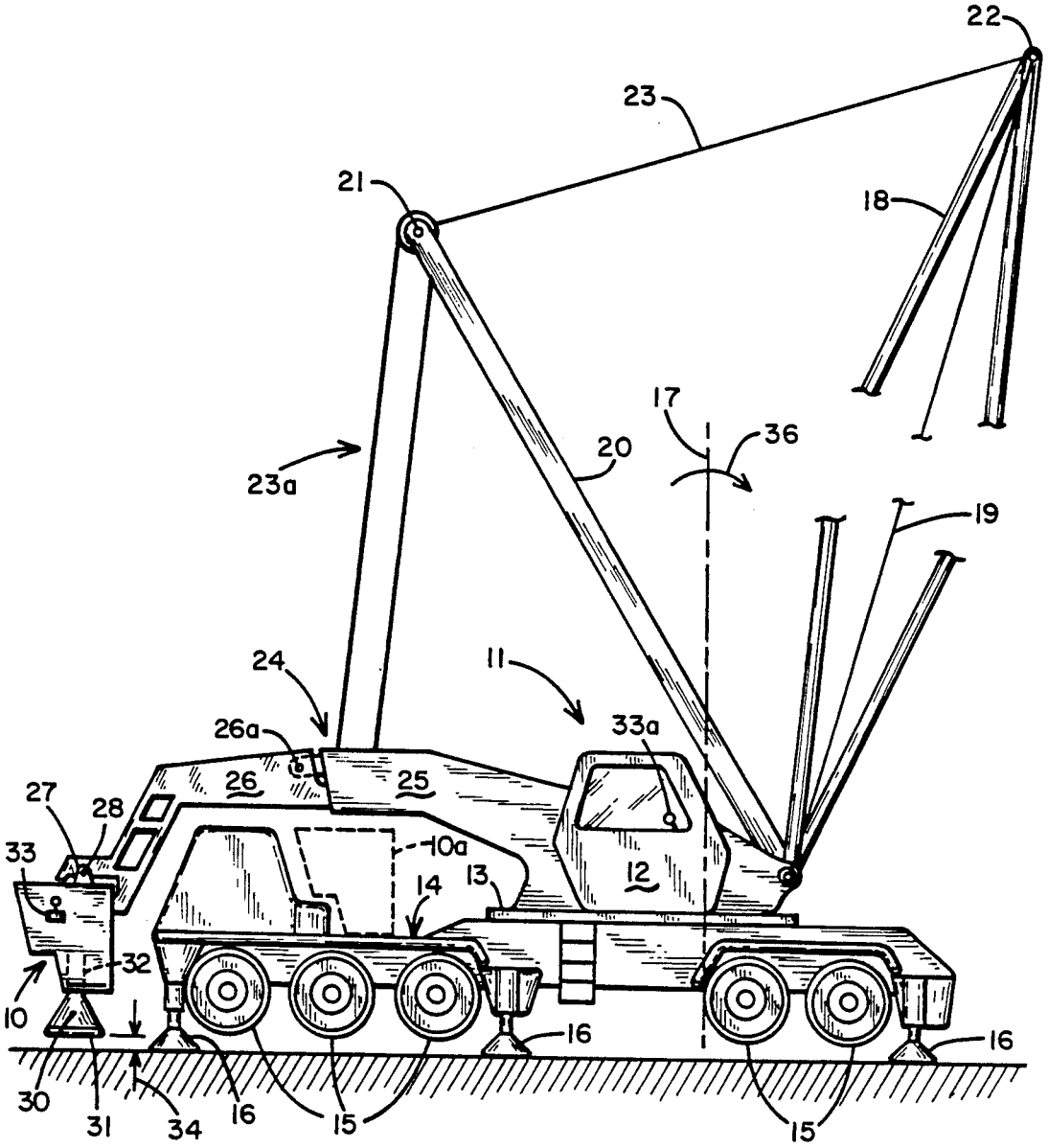
FIG. 1 is a side elevational view of the counterweight of the present invention shown attached to a conventional truck-mounted crane.

FIG. 1 shows a counterweight 10 attached to an existing truck-mounted crane 11 located in working position. The crane 11 is of conventional design having an operator cab 12 mounted upon a pivotable platform 13 carried on a transport vehicle 14. The transport vehicle 14 may be a conventional truck chassis mounted on a plurality of wheels 15 allowing its movement over public roads between the various job sites. Transport vehicle 14, further, may be supported by a plurality of outriggers 16 which may be urged downwardly into contact with the ground, stabilizing the crane 11, or retracted upwardly for transport of the crane 11.

The platform 13 is located pivotably about the first pivot axis 17 allowing it to be turned with respect to the transport vehicle 14. The platform further has a boom 18 extending upwardly and outwardly with respect to the pivot axis 17 therefrom. At least one lifting line 19 is disposed extending from the crane 11 along the length of the boom 18 and downwardly therefrom suitable for attachment to a lifting load. The lift line 19 may be extended or retracted responsive to controls within the operator cab 12 controlling winches, not shown.

A mast 20 also extends upwardly and outwardly from the platform 13 within the same plane, generally, as the counterweight 10 and further extending outwardly toward the counterweight 10. The mast top 21 is attached to the boom top 22 through the adjustable length mast suspension line 23. The mast top 21 is further attached to the crane 11 counterweight arm 24 with the adjustable length counterweight pendant 23*a*.

Figure 2:
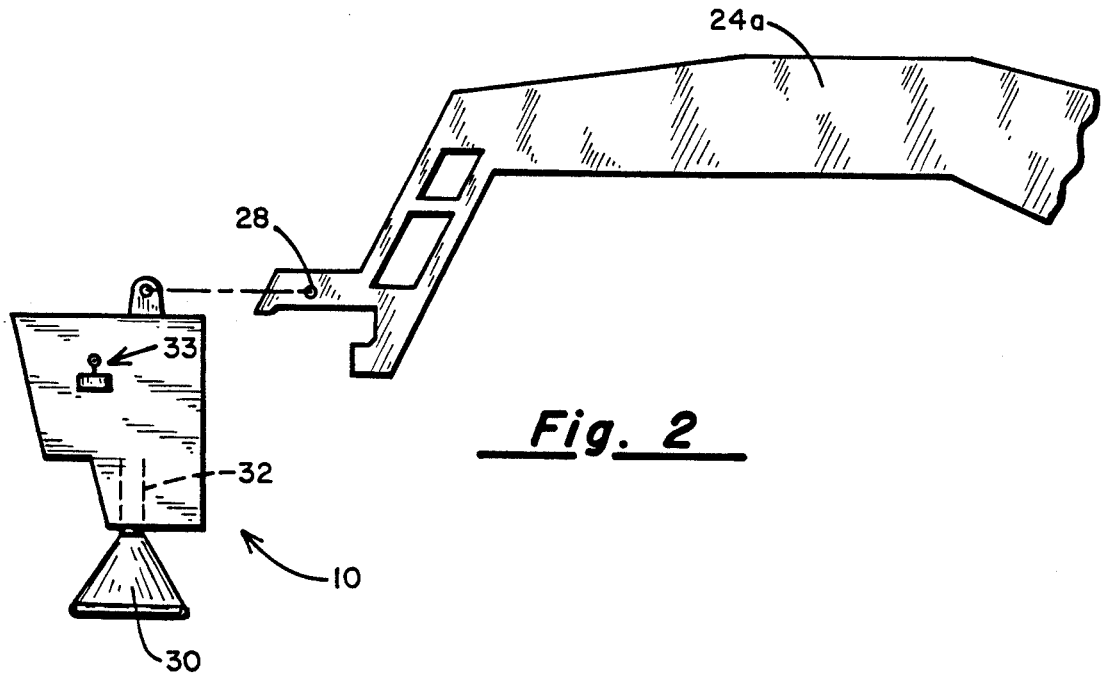
FIG. 2 is a partial side elevational view of a preferred embodiment of the present invention.

The counterweight arm 24 is attached to the crane platform 13 and extends upwardly and outwardly, opposite the boom 18, therefrom. Counterweight arm 24 may be of unitary construction, as more clearly shown as arm 24*a* in FIG. 2, or may be a bifurcated structure having a permanently attached inner arm 25 and removable outer arm 26, as shown in FIG. 1. When the bifurcated structure shown in FIG. 1 is used, the outer arm 26 is selected to have length to cooperate with the counterweight 10 to provide the counterweighting moment sufficient to offset the largest load expected to be lifted. Outer arm 26 is pivotable over a limited range of motion about removable pin 26*a*, to accommodate the counterweight movement to be its connection to inner arm 25 while crane 11 is being transported between work locations.

While the counterweight arm 24 may extend straight out from the pivot axes 17 it is preferred that the counterweight arm 24 extend downward at the distal extremity to locate the counterweight 10 nearer the ground surface and below the plane of the platform 13 in an underslung location, as shown in the figures. The counterweight 10 is attachable to the distal end of the counterweight arm 24 through the use of one of any number of suitable attachment means, such as, pins, bolts, mating hook-and-eye arrangements, or the like. It is preferred, however, that the counterweight 10 be attached to the counterweight arm 24 using removable pin 27 passing through mating holes 28 in the counterweight 10, and attachment holes 29 of the counterweight arm 24.

The counterweight 10 further has a support foot 30 extendably attached to the bottom thereof. The counterweight foot 30 has a large bottom surface 31 for supporting the counterweight 10 upon a ground or other surface. The support foot 30 is attached to the counterweight 10 through an extendable means such as a hydraulic cylinder 32. Hydraulic cylinder 32 is operable responsive to either the counterweight controls 33 or controls 33*a* contained in the operator cab 12 for extending or retracting support foot 30. Thus the counterweight foot 30 may be extended to the ground surface to support the counterweight or retracted to a variable float distance 34 to allow the counterweight 10 to be supported on the counterweight arm 24.

The counterweight 10 is further designed having a large mass and may be designed containing a large quantity of a high-density material, such as iron or steel; or may be designed as an open top container into which a high mass material such as concrete, sand, rocks or water may be contained to provide the necessary mass in the counterweight 10.

The length of counterweight arm 24 and the weight of counterweight 10 are selected so as to provide a tipping force, as measured about axis 17, which is not greater than 85 percent of the weight which would cause tipping of the crane 11. The term "85 percent tipping" is well known in the art, being a measure of the maximum loading which can occur before tipping of the crane occurs. When applied to considerations of loading of the boom 18, the amount of loading which would cause tipping of the crane about axis 17 can be calculated for all angular positions of boom 18, and the practice in the art is to restrict the loading of boom 18 to a load which is not greater than 85 percent of the calculated values. Similarly the "85 percent tipping" rule can be applied to calculate the maximum weight of counterweight 10 under all positions of rotation about axis 17. This calculation is typically made with the boom 18 positioned in its most critical position, i.e., in a nearly vertical position. An advantage of the present invention is that it permits the use of a significantly lighter counterweight than has heretofore been possible with conventional truck crane constructions. For example, counterweight 10*a*, shown in dotted outline in FIG. 1, represents the typical placement of a counterweight on a truck crane 11. In conventional truck cranes counterweight 10*a* must be sufficiently heavy to provide stability for all operational positions of boom 18, under all permissible loading conditions.

By way of example, a truck crane utilizing a counterweight positioned such as shown in 10*a* of FIG. 1 may require a counterweight of 180,000 pounds to accomplish the necessary stability, where as a truck crane utilizing counterweight 10 as shown in FIG. 1 may only require a counterweight of 100,000 pounds for the same stability. The difference between these counterweights is significant, for the extra weight of a counterweight 10*a* may be required to be transported about the work site on a separate trucking arrangement. The lighter weight of counterweight 10 may permit the counterweight to be transported about the work site while mounted to truck crane 11. In the usual work situation, a counterweight such as 10*a* can only be mounted on truck crane 11 while the crane is supported on its outriggers, and the truck crane is not maneuverable when the counterweight 10*a* is in place.

Figure 3:
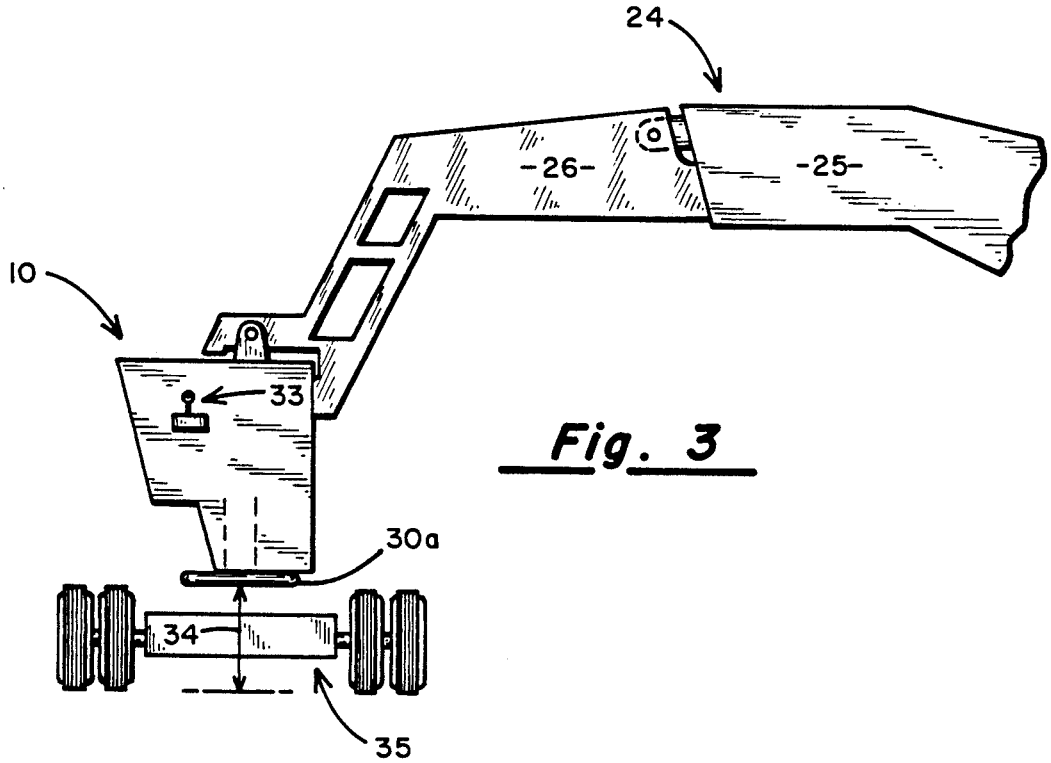

In a second embodiment of the invention, as shown in FIG. 3, the counterweight foot 30*a* is designed as a flat planar foot to allow for a greater float distance 34 above the ground. Use of the flat foot 30*a* is particularly useful when the detached counterweight 10 is to be placed upon a trailer 35 for movement between job sites.

In its use, the counterweight 10 and the crane 11 are transported using conventional means to the selected job site. The boom 18 and the mast 20 are attached to the crane platform 13 and erected, as shown in FIG. 1. If needed, the selected outer counterweight arm 26 is attached. Counterweight 10 is then placed at a suitable location radial to the pivot axis 17. Radial distance from the pivot axis 17 is controlled by the length of the counterweight arm 24 and is intended to be an extended distance such that the counterweight 10 can provide a greater anti-tipping moment to stabilize the crane 11 owing to the greater distance between the pivot axis 17 and the counterweight 10. Crane platform 13 is then pivoted upon the pivot axis 17 to locate the counterweight arm 24 directly over the counterweight 10. The counterweight 10 is then raised by extending the hydraulic cylinder 32 therein to align the mating holes 28 in the counterweight 10 with the attachment holes 29 in counterweight arm 24. When so aligned, the counterweight pin 27 may be inserted therethrough and thus secure the counterweight 10 to the counterweight arm 24. The counterweight foot 30 may then be retracted responsive to the counterweight controls 33 and set at a suitable float height 34.

The crane thus assembled, is now ready and available to perform the lifting services as necessary. When a lift is to be performed, the lift line 19 is extended and attached using conventional means to the item to be lifted. Upon retraction of the lift line 19 the lift forces are transmitted first to the boom top 22 and then through the mast suspension line 23 to the mast top 21 and through the counterweight pendant 23*a* to the counterweight arm 24 and are offset by the mass of the counterweight 10. The lifting force is thus imposed causing a tipping moment 36, as indicated by an arcuate arrow.

It should be noted that the counterweight 10 is mounted low to the ground in a generally underslung position, with respect to the plane of the crane platform 13 and thus allows the crane 11 to lift a capacity up to 85 percent of a load that would cause the crane to tip, as indicated by the tipping moment, as shown by the arrow 36, acting on the vertical axis 17.

When the crane 11 is not in use, such as at the end of the day, the counterweight foot 30 may be extended responsive either to the counterweight controls 33 or the operator cab controls 33*a*, and thus remove at least some of its effective mass from the crane thereby decreasing the tipping moment 36 of the crane 11 and increasing the stability of the resting crane 11.

The operation of the second embodiment, as shown in FIG. 3, is much the same. Here, however, the flat foot 30*a* is adapted for transport upon a trailer 35 to a job site. Thus the counterweight 10 may be readily transported using preexisting lowboy-type trailers enhancing the portability of the counterweight 10 and the crane 11.

The present invention may be embodied in other specific forms without departing from the spirit or central attributes thereof, and it is therefore desired that the present embodiment be considered in all respects as illustrative and not restrictive, reference being made to the appended claims rather than to the foregoing description to indicate the scope of the invention.

What is claimed is:

1. A combination crane assembly and detachable counterweight for counterweighting said assembly comprising (a) a crane having a platform pivotally mounted about a vertical axis supported by a ground-borne base, the platform further having a boom and a radial counterweight arm extending oppositely and outwardly from said pivot, said counterweight arm having a distal end extending outwardly beyond the longest dimension of said platform, said distal end being downwardly turned toward the ground;

(b) a counterweight having a retractable support base extendable downwardly thereform, the base terminating in a large ground engaging surface, the counterweight having at least a means for controllably extending and retracting said base;

(c) a connection means for attaching said counterweight at the distal end of said radial counterweight arm in underslung suspension, whereby a substantial portion of said counterweight is below said platform; and (d) a control means for operating said counterweight retractable support base from said crane including at least means for extending and retracting the counterweight base.

2. The appartus as described in claim 1, wherein the radial counterweight arm further comprises an inner arm attached to the platform and a removable outer arm.

3. The apparatus as described in claim 1, wherein the radial counterweight arm further comprises a detachable connecting link.

4. The apparatus as described in claim 1, wherein the counterweight base in a planar plate.

5. The apparatus as described in claim 1, wherein the counterweight base is a frusto-conical section.

6. The apparatus as described in claim 1, wherein the means for controllably extending and retracting the base further comprises, a hydraulic cylinder attached to the counterweight at a first end and attached to the base at a second end; means for providing hydraulic power; and means controlling the flow of hydraulic power to said cylinder.

7. The apparatus as described in claim 6, wherein the means controlling the flow of hydraulic power is a valve.

8. The apparatus as described in claim 1, wherein the connection means further comprises mating holes located on said counterweight and said radial counterweight arm and a counterweight retaining pin passing through said holes.

9. A combination crane assembly and detachable counterweight for counterweighting said assembly comprising (a) a crane having a platform pivotably mounted about a vertical axis supported by a ground-borne base, the platform further having a lifting means and a counterweight arm extending radially and opposingly outward from said platform, relative to said lifting means;

(b) a counterweight having a substantial mass and a base, the base extendably attached to said mass and having a frusto-conical shape for supporting the counterweight, the counterweight further having means for controllably extending said base therefrom;

(c) a connection means for attaching said counterweight proximate the end of said arm, said connection means including a linkage for suspending said counterweight beneath the underside of said arm;

(d) a control means for operating said counterweight including at least means for extending said counterweight base to contact the ground to unload the weight of suspension of said counterweight beneath said arm.

10. The apparatus as described in claim 9, wherein the arm further comprises an inner arm attached to the platform and a removable outer arm.

11. The apparatus as described in claim 10, wherein the outer arm has a downwardly directed distal end.

12. The apparatus as described in claim 9, wherein the arm extends outwardly beyond said crane.

13. The apparatus as described in claim 12, wherein the arm further comprises a downwardly extending distal end having means for detachably connecting to said counterweight.

14. The apparatus as described in claim 13, wherein the distal end of the arm extends to disposed at least a portion of the counterweight below the platform.

15. The apparatus as described in claim 9, wherein the means for controllably extending and retracting the base further comprises, a hydraulic cylinder attached to the counterweight at a first end and attached to the base at the second end; a means providing hydraulic power; and means controlling the flow of hydraulic power to said cylinder.

16. The apparatus as described in claim 15, wherein the means controlling the flow of hydraulic power is a valve.

17. The apparatus as described in claim 9, wherein the connection means further comprises mating holes located on said counterweight and said arm and a counterweight pin retained passing through said holes.

* * * * *

UNITED STATES PATENT AND TRADEMARK OFFICE

CERTIFICATE OF CORRECTION

PATENT NO. : 4,995,518

DATED : February 26, 1991

INVENTOR(S) : James R. McGhie

It is certified that error appears in the above-identified patent and that said Letters Patent is hereby corrected as shown below:

Column 3, line 9, "embodiment of the" should read -- embodiment of the invention. --; in column 3, line 63, "weight movement to be its connection" should read -- weight movement to be hereinafter described. Outerarm 26 may be removed from its connection --.

Column 5, line 47, "and through" should read -- and down through --.

Claim 14, column 8, line 8, "disposed" should be --dispose--.

--

Signed and Sealed this

Eighteenth Day of August, 1992

*Attest:*

DOUGLAS B. COMER

*Attesting Officer*

*Acting Commissioner of Patents and Trademarks*